US009314823B2

(12) United States Patent
Bamber et al.

(10) Patent No.: US 9,314,823 B2
(45) Date of Patent: Apr. 19, 2016

(54) HIGH CAPACITY CASCADE-TYPE MINERAL SORTING MACHINE AND METHOD

(71) Applicants: Andrew Sherliker Bamber, Vancouver (CA); Andrew Csinger, Vancouver (CA); David Poole, Vancouver (CA)

(72) Inventors: Andrew Sherliker Bamber, Vancouver (CA); Andrew Csinger, Vancouver (CA); David Poole, Vancouver (CA)

(73) Assignee: MineSense Technologies Ltd., Vancouver (CA)

( * ) Notice: Subject to any disclaimer, the term of this patent is extended or adjusted under 35 U.S.C. 154(b) by 327 days.

(21) Appl. No.: 13/875,105

(22) Filed: May 1, 2013

(65) Prior Publication Data

US 2013/0292307 A1 Nov. 7, 2013

Related U.S. Application Data

(60) Provisional application No. 61/640,752, filed on May 1, 2012.

(51) Int. Cl.

| | |
|---|---|
| ***B07C 5/04*** | (2006.01) |
| ***B07C 5/36*** | (2006.01) |
| ***B07C 5/34*** | (2006.01) |

(52) U.S. Cl.

CPC ... *B07C 5/04* (2013.01); *B07C 5/34* (2013.01); *B07C 5/36* (2013.01); *B07C 5/361* (2013.01); *B07C 5/362* (2013.01)

(58) Field of Classification Search

CPC ..... B07C 5/04; B07C 5/3404; B07C 5/3416; B07C 5/36; B07C 5/361; B07C 5/3425; B07C 5/3427; B07C 5/362; G01N 23/12

See application file for complete search history.

(56) References Cited

U.S. PATENT DOCUMENTS 3,263,160 A 7/1966 Dolan et al.
3,337,328 A * 8/1967 Lawver ..... B03B 9/00 209/166

(Continued)

FOREIGN PATENT DOCUMENTS

CA 2629408 A1 11/2009
DE 3228447 C2 4/1986

(Continued)

OTHER PUBLICATIONS

International Search Report and Written Opinion for International Application No. PCT/CA2013/050336, mailing date Aug. 12, 2013, 12 pages.

(Continued)

*Primary Examiner* — Joseph C Rodriguez
(74) *Attorney, Agent, or Firm* — Perkins Coie LLP

(57) ABSTRACT

Methods and systems for achieving higher efficiencies and capacities in sorting feed material are described, such as for separating desirable "good" rock or ore from undesirable "bad" rock or ore in an unsegregated, unseparated stream of feed material. Higher efficiencies are achieved with combinations of multiple sensor/diverter cells in stages in a cascade arrangement. The number and combination of cells in the cascade may be determined through a priori characterization of probabilities involved in sensor/rock and rock/diverter interactions, and mathematical determinations of the optimal number and combination of stages based on this probability. Further, desired sorting capacities are achieved through addition of multiple cascades in parallel until the desired sorting capacity is reached.

19 Claims, 8 Drawing Sheets

(56) References Cited

U.S. PATENT DOCUMENTS

| | | | | |
|---|---|---|---|---|
| 3,747,755 | A | 7/1973 | Senturia et al. | |
| 4,030,026 | A | 6/1977 | Payne | |
| 4,128,803 | A | 12/1978 | Payne | |
| 4,241,835 | A | 12/1980 | Lockett | |
| 4,300,097 | A | 11/1981 | Turner | |
| 4,507,612 | A | 3/1985 | Payne | |
| 4,659,989 | A | 4/1987 | Kerr | |
| 5,236,092 | A * | 8/1993 | Krotkov | B07C 5/02 198/609 |
| 5,523,690 | A | 6/1996 | Rowan | |
| 6,078,018 | A | 6/2000 | Davis et al. | |
| 6,664,914 | B2 | 12/2003 | Longstaff et al. | |
| 7,161,672 | B2 | 1/2007 | Gornushkin et al. | |
| 7,574,821 | B2 | 8/2009 | Furem | |
| 7,595,489 | B2 | 9/2009 | Statham | |
| 7,948,237 | B2 | 5/2011 | Kuzmin et al. | |
| 7,965,167 | B2 | 6/2011 | Volker et al. | |
| 8,100,581 | B2 | 1/2012 | Djordjevic | |
| 8,446,156 | B2 | 5/2013 | Morrison | |
| 8,515,008 | B2 | 8/2013 | Ulberg et al. | |
| 8,664,595 | B2 | 3/2014 | Buhot et al. | |
| 8,766,129 | B2 | 7/2014 | Kazakov et al. | |
| 8,820,533 | B2 * | 9/2014 | Shaw | B07C 5/3427 209/11 |
| 8,855,809 | B2 | 10/2014 | Spencer et al. | |
| 8,875,901 | B2 | 11/2014 | Wellwood et al. | |
| 8,931,720 | B2 | 1/2015 | Box et al. | |
| 8,937,282 | B2 | 1/2015 | Owen et al. | |
| 8,957,340 | B2 | 2/2015 | Wellwood et al. | |
| 8,958,905 | B2 * | 2/2015 | Bamber | B07C 5/344 37/443 |
| 2006/0090379 | A1 | 5/2006 | Furem | |
| 2010/0091103 | A1 | 4/2010 | Peltonen et al. | |
| 2011/0186660 | A1 | 8/2011 | Harding et al. | |
| 2012/0148018 | A1 * | 6/2012 | Sommer, Jr. | G01N 23/06 378/53 |
| 2012/0256022 | A1 * | 10/2012 | Box | E21C 41/26 241/24.1 |
| 2013/0026263 | A1 | 1/2013 | Bamber et al. | |
| 2013/0169961 | A1 | 7/2013 | Kraft | |
| 2013/0201481 | A1 * | 8/2013 | Bamber | G01J 3/00 356/402 |
| 2013/0292307 | A1 | 11/2013 | Bamber et al. | |
| 2013/0313169 | A1 | 11/2013 | Lapeyre et al. | |
| 2014/0088876 | A1 | 3/2014 | Shiley et al. | |
| 2014/0144342 | A1 | 5/2014 | Bye | |
| 2014/0225416 | A1 | 8/2014 | Harding et al. | |
| 2014/0260801 | A1 | 9/2014 | Wellwood et al. | |
| 2015/0108258 | A1 * | 4/2015 | Bamber | B07C 5/344 241/24.1 |

FOREIGN PATENT DOCUMENTS

| | | | |
|---|---|---|---|
| WO | 2010028446 | A1 | 3/2010 |
| WO | WO-2011116417 | A1 | 9/2011 |
| WO | WO-2013016774 | A1 | 2/2013 |

OTHER PUBLICATIONS

Bamber, Andrew Sherliker, "Integrated Mining, Pre-Construction and Waste Disposal Systems for the Increased Sustainability of Hard Rock Metal Mining," Apr. 2008, pp. 29, 37-44, 85-89. <https://circle.ubc.ca/handle/2429/779>.

Kieba et al. "Differential Soil Impediance Obstacle Detection," U.S. Department of Energy Technical Report No. DE-FC26-02NT41318, Report Issue Date Jan. 17, 2005, 72 pages.

N. G. Cutmore et al., "Ore Characterisation and Sorting," Minerals Engineering, vol. 10, No. 4., Jan. 1997, 6 pages.

Singh et al., "Application of image processing and radial basis neural network techniques for ore sorting and ore classification," Minerals Engineering, vol. 18, Jan. 2005, 9 pages.

Yang et al., "Electromagnetic conductivities of rock cores: Theory and analog results," Geophysics, vol. 62, No. 6, Nov.-Dec. 1997, 15 pages.

International Search Report and Written Opinion for International Application No. PCT/IB2012/001560, Mail Date Nov. 29, 2012, 12 pages.

International Search Report and Written Opinion for International Application No. PCT/CA2013/050330, Mailed Jul. 24, 2013, 9 pages.

International Search Report and Written Opinion for International Application No. PCT/CA2015/050683; mailed Oct. 21, 2015, 7 pages.

* cited by examiner

HIGH CAPACITY CASCADE-TYPE MINERAL SORTING MACHINE AND METHOD

CROSS-REFERENCE TO RELATED APPLICATION(S)

This application claims the benefit under 35 U.S.C. 119(e) of U.S. Provisional Application No. 61/640,752, filed on May 1, 2012, entitled "High Capacity Cascade-Type Mineral Sorting Machine," which is hereby incorporated by reference for all purposes in its entirety. This application is related to U.S. application Ser. No. 13/538,931, filed Jun. 29, 2012, entitled "Extracting Mined Ore, Minerals or Other Materials Using Sensor-Based Sorting," which in turn claims the benefit of U.S. Provisional Application No. 61/502,772, filed on Jun. 29, 2011, entitled "Method for the Pre-Concentration of Mineral Ores" and U.S. Provisional Application No. 61/502,760, filed on Jun. 29, 2011, entitled "High Frequency Electromagnetic Spectrometer," all of which are hereby incorporated by reference for all purposes in their entireties. This application is related to U.S. patent application Ser. No. 13/830,453, entitled "Sorting Materials Using Pattern Recognition, Such As Upgrading Nickel Laterite Ores Through Electromagnetic Sensor-Based Methods," which is hereby incorporated by reference for all purposes in its entirety.

BACKGROUND

In the field of mineral sorting, sorting machines generally comprise a single stage of sensor arrays controlling via micro controller or other digital control system a matched array of diverters, usually air jets. Sensors can be of various forms, either photometric (light source and detector), radiometric (radiation detector), electromagnetic (source and detector or induced potential), or more high-energy electromagnetic source/detectors such as x-ray source/detector (fluorescence or transmission) or gamma-ray source/detector types. Matched sensor/diverter arrays are typically mounted onto a substrate, either vibrating feeder, belt conveyor or free-fall type, which transports the material to be sorted past the sensors and thus on to the diverters where the material is diverted.

BRIEF DESCRIPTION OF THE DRAWINGS

Embodiments of the present disclosure will be described and explained through the use of the accompanying drawings in which.

Figure 1:
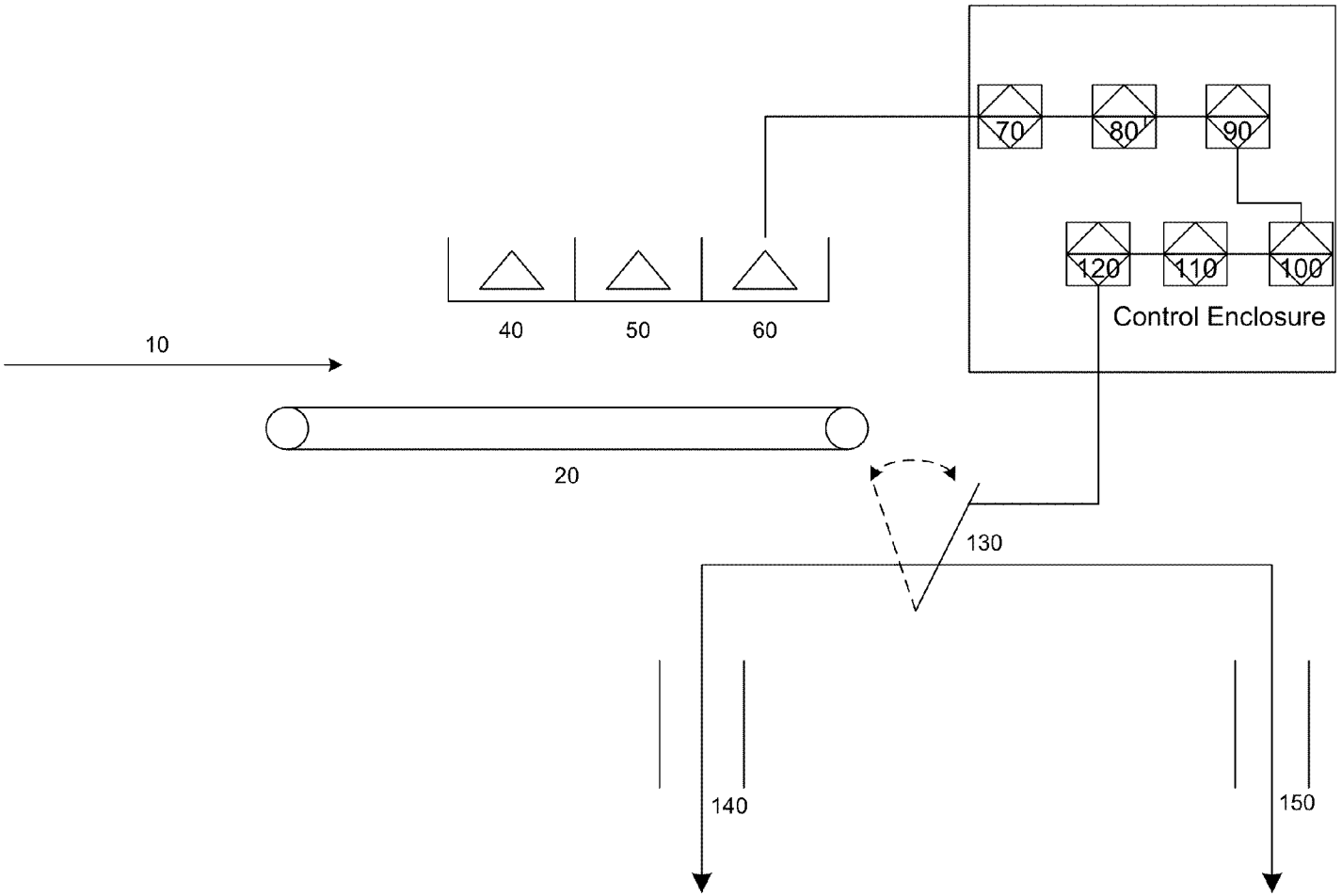
FIG. 1 illustrates an example of a single sensor/diverter sorting cell.

The drawings have not necessarily been drawn to scale. For example, the dimensions of some of the elements in the figures may be expanded or reduced to help improve the understanding of the embodiments of the present invention. Similarly, some components and/or operations may be separated into different blocks or combined into a single block for the purposes of discussion of some of the embodiments of the present invention. Moreover, while the disclosure is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosure.

DETAILED DESCRIPTION

Sorting is typically undertaken by one or more high-efficiency machines in a single stage, or in more sophisticated arrangements such as rougher/scavenger, rougher/cleaner or rougher/cleaner/scavenger. Sorter capacity is limited by several factors including microcontroller speed, belt or feeder width, and a typical requirement to a) segregate the feed over a limited particle size range, and b) separate individual particles in the feed apart from each other prior to sorting to ensure high efficiency separation (i.e., establishing a "monolayer" of particles).

As disclosed herein, higher efficiencies in sorting unsegregated, unseparated feed material are achieved through unique combinations of multiple sensor/diverter stages in a cascade arrangement, the number and combination of stages in the cascade determined through a priori characterization of sensor/rock and rock/diverter interactions and mathematical determination of the optimal number and combination of stages based on probability. Further, as disclosed herein, desired sorting capacities are achieved through addition of multiple cascades in parallel until the desired sorting capacity is reached.

In the present disclosure, suitably crushed mineral feed is sorted at high capacity in a cascade-type sorting machine. In some embodiments, the cascade-type sorting system comprises an array of discrete sensor/diverter (sorting) cells arranged in such a way as the sorting process occurs in a series of discrete steps comprising the sorting cells operating in parallel, until a final product of acceptable quality is separated from a final tailing or "reject" material stream.

The sorting cascade (or cascades) may be preceded by size classification stages, typically one to remove fine material which is possibly not to be sorted, and a second stage to create both a coarse fraction suitable for treatment in a coarse-particle cascade, and a fine fraction suitable for treatment in a fine-particle cascade. For an arbitrary order of cascade, the $i^{th}$ sorting cell receives a feed input, and from the feed input produces intermediate outputs which may either go to a further $j^{th}$ sorting cell or final outputs; the $j^{th}$ cell similarly may produce outputs which go to a further stage of sorting, or are combined with $i^{th}$ cell outputs to make a final product stream; similarly, individual output streams from $i^{th}$ and $j^{th}$ sorters can be sent to a further set of cells or are combined to make a final tailing stream.

Individual sensor/diverter cells in the sorting system are controlled by individual embedded industrial computers embodying, e.g. rapid pattern recognition algorithms for mineral content analysis, and high speed control interfaces to pass instructions to high speed electromechanical diverters. The cascade may comprise numerous stages of sensor/diverter cells in series; stages may alternately comprise multiple channels of sensor/diverter cells in parallel. The sorting stages comprising the entire sorting cascade are coordinated by a marshaling computer (or computers) which provides the overall sorting algorithm and allows online adjustment of separation metrics across the entire cascade. In some embodiments, the sensing algorithm deployed embodies concepts of mineral recognition adapted from biometric security. The sorting algorithm embodies iterative Bayesian probability algorithms governing particle recognition and diversion determining the configuration of sensing/sorting cells required to achieve a given objective.

The techniques described herein may maximize the treatment capacity of a mineral sorting solution by embracing the imperfection of individual sensor/diverter cells through eliminating the need for a) a mono-layer of particles and b) the segregation of the particles in space in combination with the exploitation of a priori knowledge of the inherent imperfection of the sorting cells to determine the number of sorting stages to achieve an efficient and effective separation of minerals at the desired capacity.

FIG. 1 illustrates an example of a single sensor/diverter (sorting) cell. The sorting cell illustrated in FIG. 1 includes material feed stream 10, feed mechanism 20, sensor array comprising source array 40, detector array 50, and embedded computer 60 communicating via signal cable with a control enclosure comprising analogue to digital conversion stage 70, digital signal processing stage 80, and comparator function stage 90, connected to the diverter control stage comprising micro controller 100, programmable logic controller ("PLC") 110, actuator array 120 and diverter gate array 130. In some embodiments, the sensor element may be passive. In some embodiments, signals analyzed by the digital signal processor 80 are compared via conditional random field-type pattern matching algorithm with nearest neighbor detection to a previously determined pattern in the comparator function stage 90 to determine whether the material meets or exceeds an acceptable content threshold, and control signals for acceptance or rejection of the material, as appropriate, are sent to the diverter array micro controller 100.

In use, feed material in material feed stream 10 entering the sorting cell may be separated into "accept" product 140 or "reject" product 150 streams based on mineral content determined by the sensor array 40, 50, and 60 and compared to a pre-determined value by the comparator function 90.

Figure 2:
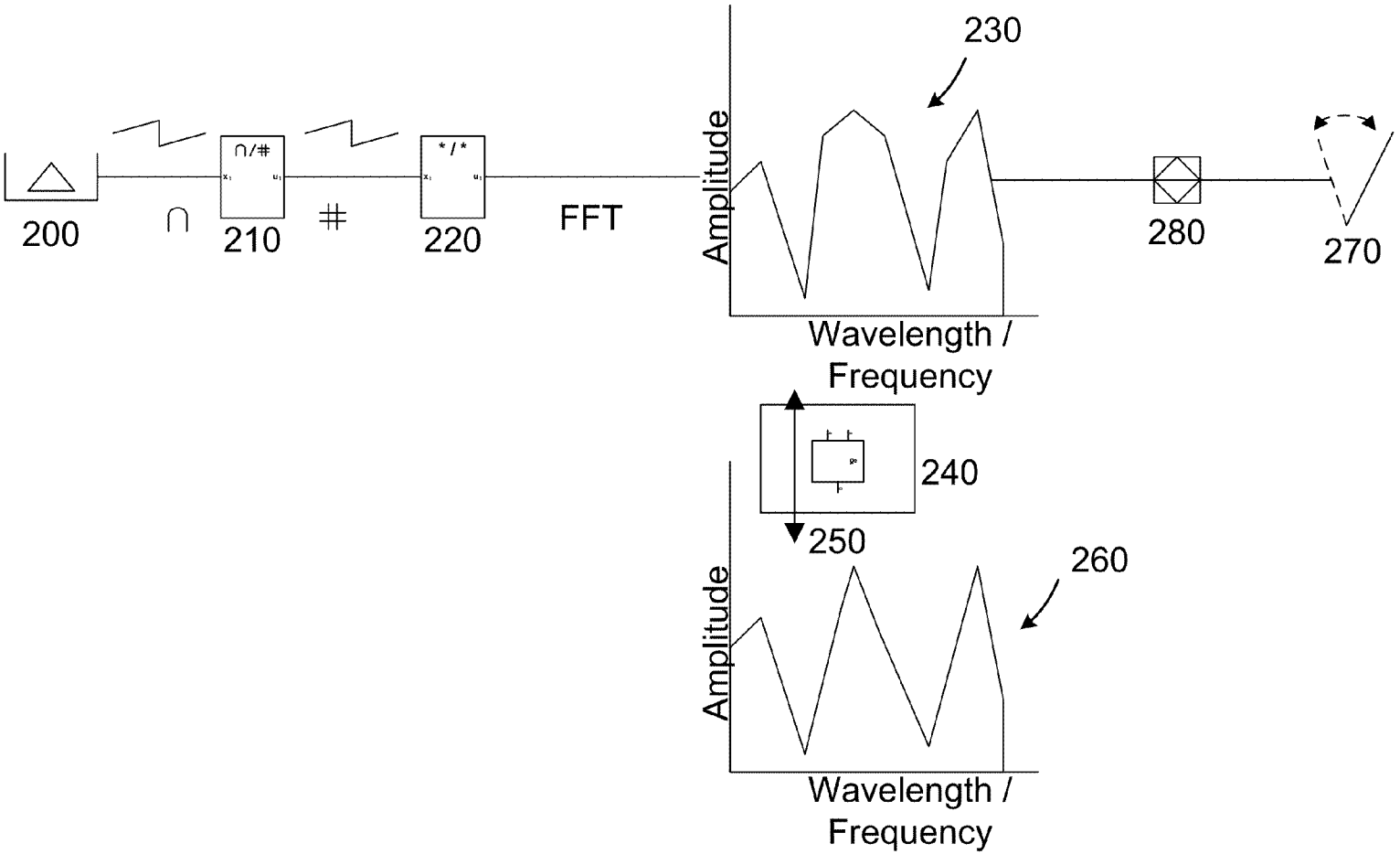
FIG. 2 illustrates an example of signal analysis and pattern matching algorithms.

FIG. 2 illustrates a mineral recognition algorithm. Generally, the mineral recognition algorithm may include an analogue to digital conversion, Fourier analysis of spectrum, spectral pattern recognition algorithm, comparator function, and digital output stage.

More specifically, in FIG. 2, analogue signals of arbitrary waveform and frequency from the detector array 200 are converted by analogue to digital signal converter 210. Digital signals from the digital signal converter 210 are passed to the Fourier analysis stage where spectral data of amplitude/frequency or amplitude/wavelength format are generated by Fast Fourier Transform implemented on a field programmable gate array 220 or other suitable element(s), such as at least one digital signal processor (DSP), application specific integrated circuit (ASIC), any manner of processor (e.g. microprocessor), etc. Indeed, many of the components disclosed herein may be implemented as a system-on-chip (SoC) or as similar technology. Arbitrary power spectra generated 230 in the Fourier Analysis stage 220 are compared to previously determined and known spectra 260. Spectra of desired material are recognized by conditional random field-type pattern matching algorithm ("CRF") with nearest neighbor detection 240 running on the embedded computer 250. Other pattern matching algorithms are possible and the embodiments are not limited to CRF.

Recognition of desired material results in "accept" instructions being passed from the embedded computer 250 to the diverter array 270 via the PLC 280. Recognition of undesired material results in "reject" instructions being passed to the diverter array 270, whereas recognition of desired material results in "accept" instructions being passed to the diverter array 270.

Figure 3:
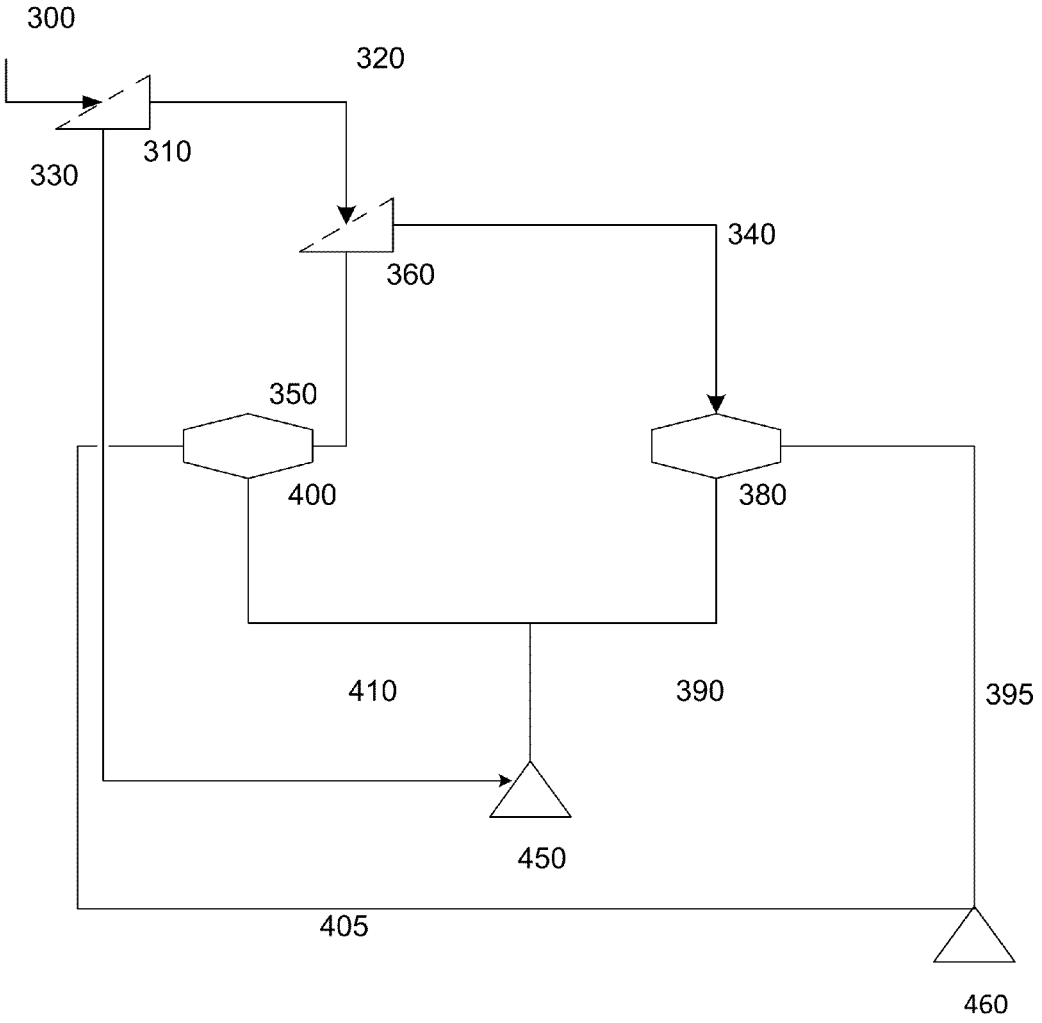
FIG. 3 illustrates an example of an arrangement of sorting cascades with a priori size classification stages.

FIG. 3 illustrates an example of an arrangement of sorting cascades operating in combination with a preceding size classification stage. The arrangement may include a fine removal stage, coarse/fine size classification, and both coarse and fine sorting cascades of arbitrary dimension. The coarse and the fine sorting cascades may both deliver appropriately classified material to either a final product or final tailing stream. Coarse and fine sorting cascades are controlled by the central marshaling computer which governs the macro behavior of the cascade according to pre-determined probabilities of correct sensing and diversion of "good" rocks to "good" destinations, and predetermined probabilities of sensing and diversion of "bad" rocks to "bad" destinations, treating rocks with a random distribution of "good" and "bad" values, and the spectral patterns sensed for "good" and "bad" rocks respectively have been determined through a priori characterization. The probability of correct separation is then used to determine the appropriate number of stages required for effective separation. The processes of a typical sorting cascade are described below in more detail in terms of Bayesian probability.

FIG. 3 illustrates a mineral feed stream input into a size classification stage followed by multiple stages of sensor-based recognition, discrimination and diversion. These stages lead to two output mineral streams, a final product (or "accept") stream, and a final tailings (or "reject") stream. Mineral feed of arbitrary particle size distribution 300 is classified by a primary size classification stage 310. Fine material stream 330 from the size classification stage underflow can be taken to final product stream 450 or sorted. Overflow 320 from the primary size classification stage 310 is separated into a coarse stream 340 and fine stream 350 by the secondary size classification stage 360. Coarse material in the coarse stream 340 is sorted in a coarse sorting cascade 380, delivering a coarse product stream 390 and coarse tailings stream 395. Fine material in the fine stream 350 is sorted in a fine sorting cascade 400, delivering a fine product stream 410 and fine tailings stream 405.

Primary size classifier underflow in the fine material stream 330, coarse sorting cascade product stream 390 and fine sorting cascade product stream 410 are combined in a final product stream 450. Coarse sorting cascade tailings stream 395 and fine sorting cascade tailings stream 405 are combined in a final tailings stream 460.

The number of stages in each coarse sorting cascade is determined by a cascade algorithm configured by a priori knowledge of the probability of correct sensing and diversion of "good" rocks to "good" destinations, and predetermined probabilities of sensing and diversion of "bad" rocks to "bad" destinations, and expected spectral patterns sensed for "good" and "bad" rocks respectively having been determined through a priori characterization. The configuration algorithm can be understood as a combination of iterated Bayesian probabilities, summarized in the form of parameters similar to those used in the biometric authentication industry, where the notions of False Acceptance, False Rejection and Equal Error Rate have isomorphic qualities. Consider the trajectory of a "good" rock in the sorting process. It is either accepted during the first stage of the sorting cascade, or it is "Falsely Rejected." A bad rock, similarly, is either rejected at this stage, or it is "Falsely Accepted." The following concerns only the False Rejection of rocks that should make it past the respective stages of the cascade, and with the False Acceptance of rocks which should not.

Given a mineral feed stream comprising a random composition of m rocks, i.e., n good and m-n bad, each rock of the stream will be categorized as being one of a predetermined set of types which are a priori ascertained by analysis of a representative sequence of similar rocks for calibration and evaluation purposes only.

Now referring to a sorting plant comprised of a cascade of sensor/diverter cells, where the sorting plant includes:

- a set of sorting cells $s_1, s_2, \ldots s_n$, such that each cell $s_i$ takes a distribution of rocks and sorts it into $b_i$ conveyer belts which then go onto other cells or to a final destination;
- a set D of final destinations (e.g., "accept" or "reject", but there can be arbitrarily many), and;
- a set of connections (implemented for instance as conveyer belts), that takes rocks from an output of a cell to another cell or to a final destination.

Let $C_{ij}$ be the location where output j of cell $s_i$ goes. If $C_{ij}=s_k$ then $s_k$ has an input from $s_i$. Assume that the cells are arranged in an acyclic ordering, where there is an initial cell $s_1$ which has, as input, the input to the sorting cascade itself, and all cells $s_i$ (except for $s_1$) have at least one input.

Now referring to a cascade sorter comprised of i stages of cells: for each sorter $S_i$, rocks are sorted into one of $b_i$ streams. For each rock, let $S_i$ be the output of the sorter. Thus $S_i=j$ means that the rock is output to stream j. Each sorter is characterized by:

$$P(S_i=j|t)$$

where t is the type of the rock (e.g., "good" or "bad"). This probability could be dependent on parameterizations of the sorter, such as a threshold level of desired ore content detected or sensed in a rock.

Now referring to the ultimate yield of the separation: for each sorter, the final destination of the sorter is defined to be the final destination of the rocks that come into the sorter. For sorter $s_i$ and for each rock, $S_i^*=d$ means that the rock coming into $s_i$ ends up in destination d. The probability $P(S_i^*=d|t)$ defines the probability of a rock of type t that comes into $s_i$ ending up in destination d. This can be defined recursively for all of the cells:

While there are some sorters for which the system may not compute $P(S_i^*=d|t)$, there is always a sorter such that all of the outputs are connected to final destinations or to sorters for which this quantity has been computed. Then $P(S_i^*=d|t)$ can be computed as follows:

$$P(S_i^*=d|t)=\Sigma_j P(S_i=j|t)P(C_{ij}^*=d|t)$$

where $P(C_{ij}^*=d|t)$ is $P(S_k^*=d|t)$ if $C_{ij}=s_k$. That is, if $C_{ij}$ goes to cell $s_k$. The system has already computed $P(S_k^*=d|t)$:

1 if $C_{ij}$ is connected to destination d.

0 if $C_{ij}$ is connected to a destination other than d.

The performance of the whole sorter is characterized by $P(S_1^*=d|t)$, and the environment, which is characterized by the distribution over types, P(t).

Now referring to the efficiency of separation, if there are two rock types (good and bad) and two destinations (good and bad), the confusion matrix can be defined as:

| | rock positive | rock negative |
|---|---|---|
| destination positive | $t_p = P(S_1 = g\|t = good)P(t = good)$ | $f_p = P(S_1 = g\|t = bad)P(t = bad)$ |
| destination negative | $f_n = P(S_1 = b\|t = good)P(t = good)$ | $t_n = P(S_1 = b\|t = bad)P(t = bad)$ |

These can be plotted for various plants and/or parameter settings.

In general, a utility u(d; t) can be defined for each destination d and type t. In this case, the utility of the sorter is $\Sigma_t\Sigma_d P(S_1=d|t)P(t)u(d; t)$. A plant or parameter settings can be chosen to optimize the utility for maximum yield at maximum efficiency given a priori knowledge of the rocks.

Figure 4:
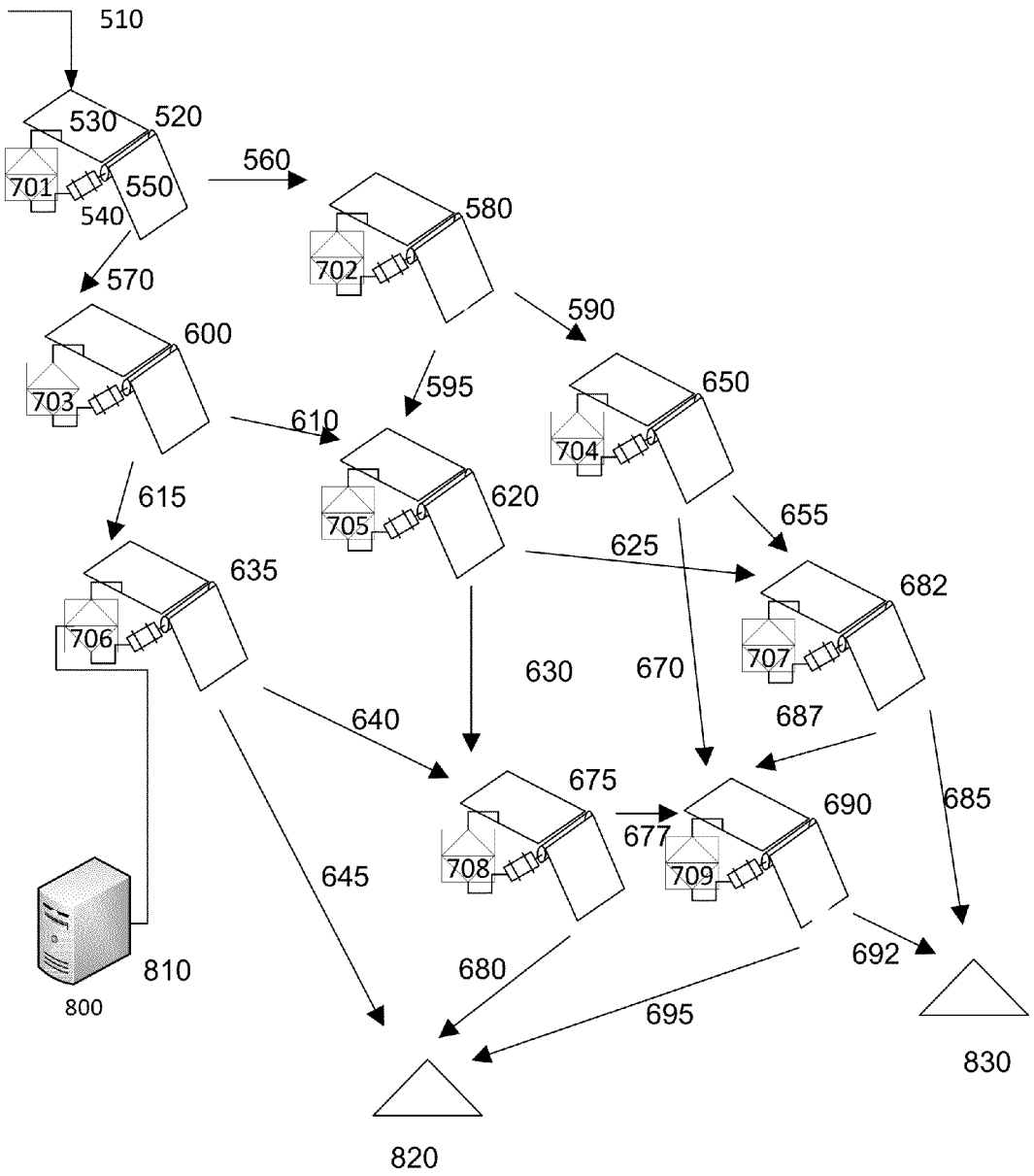
FIG. 4 illustrates an example of a typical sorting cascade of arbitrary dimension.
Figure 5A:
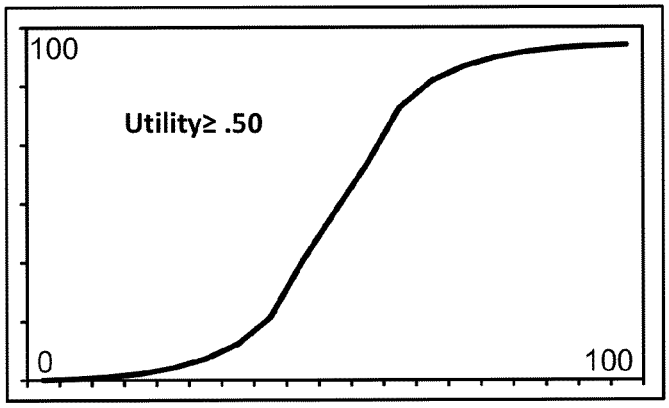
FIGS. 5A-D illustrate examples of resulting feed partition curves for typical parameterizations of a cascade.
Figure 5B:
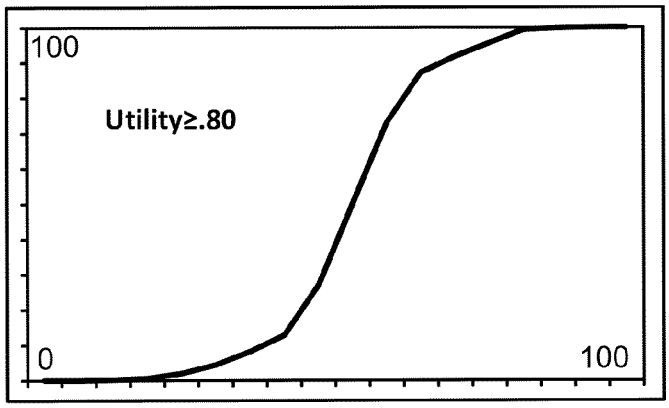
Figure 5C:
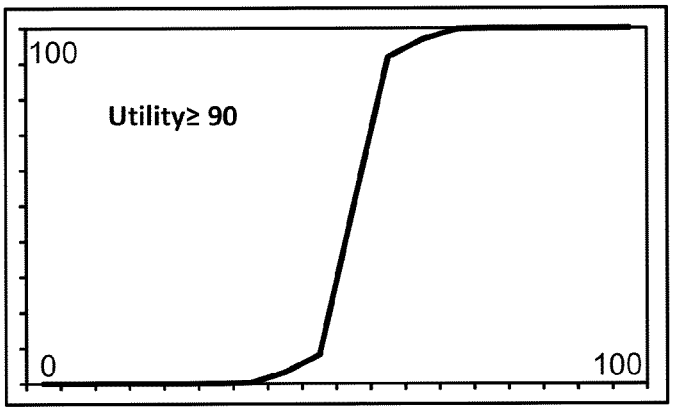
Figure 5D:
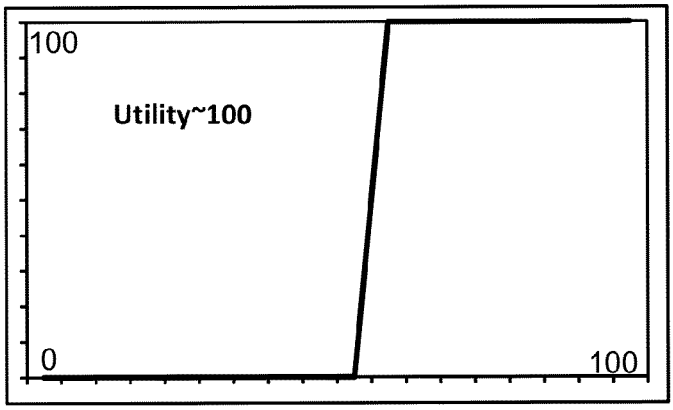

FIG. 4 illustrates an embodiment of a typical sorting cascade in more detail comprising arrays of sorting cells in a calculated arrangement of stages delivering sorted material to final product and tailings streams. The cascade has a utility according to pre-determined $P(S_i^*=d|t)$.

FIG. 4 illustrates an example of an arbitrary sorting cascade. The selected probability or number of stages shown is only one example—many others are possible. Any geometric configuration involving any number of sorting cells in any interconnection relationship thereamong is contemplated by this disclosure, as long as each sorting cell accepts input, and has a destination to which its output is directed, and behaves as parameterized. Further, thresholding for initial cells in the particular embodiment may be different to that of subsequent cells in the embodiment as separation criteria refine over the progress of rocks towards "accept" or "reject" destinations in the cascade.

In the example shown, mineral feed is delivered to the sorting cascade via the feed chutes 510 via gravity (or other mechanism). Material from the feed chute is delivered to the first stage sorting cell 520 comprising feed mechanism 530, sensor 540 and diverter 550 by gravity. First stage sorting cell 520 separates the feed material into accept and reject fractions 560 and 570, respectively. The accept fraction 560 is delivered to the next stage of sorting 580 similarly comprised to the previous sorting cell 520, where the material is again separated into accept fraction 590 and reject fraction 595. The reject fraction 570 is delivered to the next stage of sorting 600, which is similarly comprised to the first sorting cell 520, where the material is again separated into accept fraction 610 and reject fraction 615. The accept fraction 610 is delivered to the next stage of sorting 620, which is similarly comprised to the first sorting cell 520, where the material is again separated into accept fraction 625 and reject fraction 630. The reject fraction 615 is delivered to the next stage of sorting, sorting cell 635, which is similarly comprised to the first sorting cell 520, where the material is again separated into accept fraction 640 and reject fraction 645. Unit separation of material into accept and reject fractions occurs similarly through the cascade until the material is sorted into a final reject material delivered to the final reject stream 820, and a final accept material delivered to the final accept pile 830.

Sorting cells, such as sorting cells 520, 580, and 600 are controlled by individual embedded computers 701 . . . 709 housing the pattern recognition algorithm 240. All embedded computers 701 . . . 709 are controlled by a central marshaling computer 800 housing the cascade sorting algorithm 810 with a priori knowledge of the accept/reject probability. Alternatively, the embedded computers perform only basic functions (e.g., controlling material separation), but sensor data from each cell is sent to the central computer for analysis, e.g., pattern recognition, and the central computer sends accept/reject signals back to each embedded computer for controlling the diverters. Some or all sorting cells may include sensors, with all sensors being similar, but the system is configured to sense differing thresholds of a desired material or ore for each cell (e.g. detect a particular waveform). Alternatively or additionally, some or all sensors may differ from other sensors to, e.g., sense different materials in the rock (e.g. to identify two different, desirable materials in the material stream), or to employ different sensing techniques for sensing the same material (e.g. photometric, radiometric, and/or electromagnetic sensors).

FIG. 5 illustrates a series of partition curves for the embodiment described in FIG. 4. In FIG. 5, a series of partition curves describing sorting Utility over a range of $P(S_i^*=d|t)$ are shown. In FIG. 5A a partition curve for Utility≥0.5 is shown. In FIG. 5B a partition curve for Utility≥0.8 is shown. In FIG. 5C a partition curve for Utility≥0.9 is shown. In FIG. 5D a partition curve for Utility approaching 1.0 is shown. The curves show that for values of Utility≥0.5 that statistically acceptable sorting outcomes are achieved for values not much greater than 0.5 in a limited number of sorting stages. In this way, statistically acceptable sorting outcomes can be achieved over multiple stages of sorting steps of individually unacceptable sorting performance.

Suitable Method of Determining Content

The description below, including the description relating to FIGS. 6 and 7, discuss a particular method and system for determining the content of mineral samples. Other embodiments are contemplated. In some embodiments, the variable chemical composition of unblended mineral samples or streams may be determined by exposing the mineral sample or stream to electromagnetic radiation and measuring a signal produced therefrom, such as an absorption, reflectance or Compton backscatter response. A machine comprising arrays of source-detector-type mineral sensors, coupled to high-speed, digital signal processing software incorporating rapid pattern recognition algorithms scans the ore stream in real-time and interprets the chemical composition of the ore.

Referring now to the pattern recognition algorithm in more detail, the concepts of recognition and identification as used in biometric security are introduced. Automated digital signal analysis is conventionally applied for pattern recognition using an exact matched, or identified, signal. In spectrum matching, both wavelength and amplitude, or frequency and amplitude of an arbitrary power spectrum are to be matched. Traditional pattern matching requires comparison of every inbound spectrum to the sample spectrum to achieve an exact match and is computationally very intensive and time consuming and therefore not practical in high-speed mineral recognition applications. Recognition is hereby differentiated from identification, or matching, for the purpose of the present system. As used in biometric security, for instance, recognition is the verification of a claim of identity, while identification is the determination of identity. These scenarios loosely correspond to the use of sensor telemetry for classification (e.g., sorting applications in the field) and characterization (e.g., analytical operations in the laboratory). To build further intuition, the biometric identification/recognition scenario will be further elucidated:

Identification: In the laboratory, a sample might be subjected to, for example, an X-ray Fluorescence sensor for analytic purposes. In the mining practice of interest, a spectral pattern is created in the lab using analytical procedures (i.e., samples from the deposit of interest are characterized or identified using analytical procedures in the lab). This is to say that the objective of the sampling is to yield the most accurate and precise result: a sensor-based assay. In this way the identity of a mineral sample as determined by sensor-based techniques is a priori determined. This template is programmed into field units so that results from new samples can be compared to it in quasi-real time.

The biometric analogy might go as follows: You are returning to your home country at one of its major international airports and have the option of using a kiosk equipped with an iris scanner. You simply approach the kiosk and present only your eye for examination by the scanner. The kiosk reads your iris and prints out a receipt with your name on it for you to present to a customs agent. The kiosk has clearly searched for a closest match to the sample you just provided, from a database of templates. You have been identified by the kiosk. Leaving aside the question of whether or not this is good security practice, it is clear that the kiosk is programmed to minimize the possibility of identity fraud (i.e., the incidence of false acceptance).

Recognition: In the field, samples are to be analyzed quickly—in quasi-real time—in order to produce economically viable results. There is neither time nor, as it turns out, need for exactitude in matching. A sample is to simply match the a priori pattern within a pre-determined tolerance; it is then recognized as a positive instance, or else it is classified as a negative instance.

It is therefore necessary only to recognize the emerging spectral pattern, based on the a priori identification described above, in time to make a classification decision.

The biometric analogy might go as follows: You are returning to your home country at one of its major international airports and have the option of using a kiosk equipped with an iris scanner. You approach the kiosk and present your passport, thereby making an identity claim. You then present your eye for examination by the scanner. The kiosk reads your iris and compares the sample to a stored template (derived, perhaps, from information encrypted in your passport). Identity has been rapidly confirmed by recognition of the subject based on a priori knowledge of the subject content. This is analogous to the pattern recognition algorithm deployed in various embodiments of the present invention.

The advanced pattern recognition methodology deployed involves pattern learning (or classification) of absorbed, reflected or backscattered energy from the irradiation of previously characterized mineral samples and pattern recognition comprising fuzzy analysis and resource-bounded matching of absorption, reflectance or backscattered spectra from newly irradiated mineral samples through a trained CRF algorithm. The algorithms that match of absorption, reflectance or backscattered spectra may be resource-bounded, meaning that energy physics determines when measurement of a sample is complete.

Referring now to the CRF algorithm, CRF involves the "training" of the random field on known spectra, as well as the use of the random field under resource bounded conditions to rapidly recognize new spectra similar to the "trained" spectrum. In contrast to an ordinary matching algorithm which predicts a result for a single sample without regard to "neighboring" samples, the CRF algorithm deployed predicts a likely sequence of results for sequences of input samples analyzed. Let X be an array observed spectral measurements with Y a corresponding array of random output spectra. Let $$S=[V,E] \tag{1}$$

be a set of spectra such that $$Y=(Yv)_{v\in V} \tag{2}$$

so that Y is indexed by the vertices of S. Then (X,Y) is a conditional random field when the random variables Yv, conditioned on X, obey the Markov property $$p(Yv|X, Yw, w\neq v)=p(Yv|X, Yw, w\ v) \tag{3}$$

where w v means that w and v are neighbours or near neighbours in S. The conditional distribution $$p(Y|X) \tag{4}$$

is then modeled. Learning parameters θ are then obtained by maximum likelihood learning for $$p(Yi|Xi;\theta) \tag{5}$$

where all nodes have exponential family distributions and optimization is convex and can be solved by, e.g., gradient-descent algorithms. The learning, or characterization, phase involves identifying common characteristic spectra generated from a series of samples by repeated exposure of the spectral analyzer to the samples. These characteristic features may then be used for efficient and rapid spectrum recognition for new samples with similar spectra.

As discussed, FIG. 2 references a pattern recognition algorithm of the CRF-type, using back-propagation when in the training mode to define matching coefficients e for the conditional random field, which additionally incorporates pseudo-random sampling, and boundary detection comprising confirmation of the spectral upper and lower bounds. The system is trained to recognize the presence of a range of typical mineral constituents in a matrix such as iron, aluminum, silica and magnesium present in a sample which is moving with reference to the sensor, calculate the specific and total concentration of each element in the sample and compare it to the pre-defined spectrum of known material obtained during the "training" phase of the algorithm development.

Other pattern recognition algorithms such as inter alia brute-force, nearest-neighbour, peak matching etc. may be used. As such, embodiments of the present invention are not limited to the particular algorithm described. For example, the peak frequencies from a few samples with certain amplitudes may be identified, and then each sample may be analyzed for peaks near those frequencies and above a certain amplitude.

Figure 6:
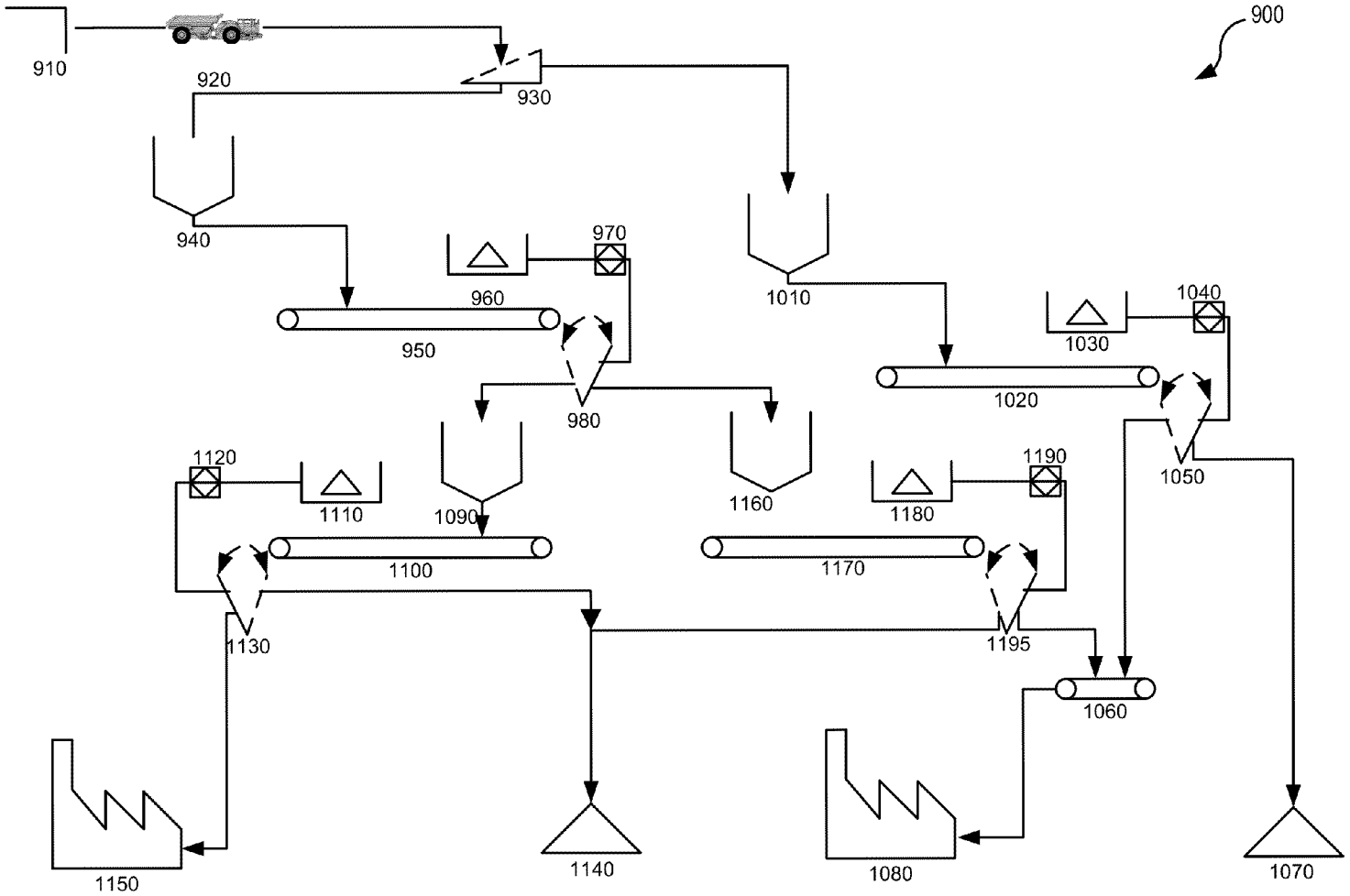
FIG. 6 illustrates an example of an arrangement of a sorting system.

FIG. 6 illustrates an example of an arrangement of a sorting system in an open pit mining application. Embodiments depicted in FIG. 6 may be used, for example to classify a pyrometallurgical process feed, a hydrometallurgical process feed and a waste product simultaneously from the same deposit. Typical bulk open pit mining equipment delivers unblended mineral feed to an ore sorting facility comprising arrays of electromagnetic sorting machines described. Saprolitic material produced by the sorting facility is delivered to pyrometallurgical plant 1080. Limonitic material simultaneously recovered by the sorting facility is delivered to hydrometallurgical plant 1150. Waste material simultaneously recovered by the sorting facility is delivered to waste piles 1070, 1040 for repatriation to the open pit.

Unblended laterite material 910 from the open pit may be delivered by truck 920 to coarse separator 930. Fine fractions from separator 930 underflow may be passed to fine sorter feed bin 940 where material may be held prior to delivery to sorting conveyor 950. Material travelling on the sorting conveyor 950 may be scanned by an array of electromagnetic sensors 960. Results from the electromagnetic sensors 960 may be passed to controller 970 which compares the sensor results to pre-set values and may instruct the diverter 980 to divert the material according to its chemical content. High iron limonitic material may be diverted to limonite sorter 1090. High silica saprolitic material may be diverted to saprolite sorter feed bin 1160.

High iron limonitic material from the sorting conveyor 950 may be passed to the limonite sorter feed bin 1090 where material is held prior to delivery to sorting conveyor 1100. Material traveling on the sorting conveyor 1100 may be scanned by an array of electromagnetic sensors 1110. Results from the electromagnetic sensors 1110 may be passed to controller 1120 which compares the sensor results to pre-set values and instructs diverter 1130 to divert the material according to its chemical content. Material not suitable for treatment is diverted to the waste pile 1140. Limonitic material suitable for treatment is passed via the limonite product conveyor to the hydrometallurgical facility 1150.

Similarly high silica saprolitic material from the sorting conveyor 950 may be passed to saprolite sorter feed bin 1160 where material may be held prior to delivery to sorting conveyor 1170. Material travelling on the sorting conveyor may be scanned by an array of electromagnetic sensors 1180. Results from the electromagnetic sensors 1180 may be passed to the controller 1190 which compares the sensor results to pre-set values and instructs the diverter 1195 to divert the material according to its chemical content. Material not suitable for treatment is diverted to the waste pile 1140. Saprolitic material suitable for treatment is passed via the saprolite product conveyor 1060 to pyrometallurgical facility 1080.

Coarse fractions from the separator 930 overflow may be passed to coarse sorter feed bin 1010 where material may be held prior to delivery to the sorting conveyor. Material traveling on sorting conveyor 1020 may scanned by an array of electromagnetic sensors 1030. Results from the array of electromagnetic sensors 1030 may be passed to controller 1040 which compares the sensor results to pre-set values and instructs the diverter array 1050 to divert the material according to its chemical content. High nickel saprolitic material may be diverted to saprolite product conveyor 1060. Low nickel, high iron and high silica material may be diverted to the waste pile 1070. Note that some elements may be combined together, such as a single controller that performs comparisons and instructs diverters.

Figure 7:
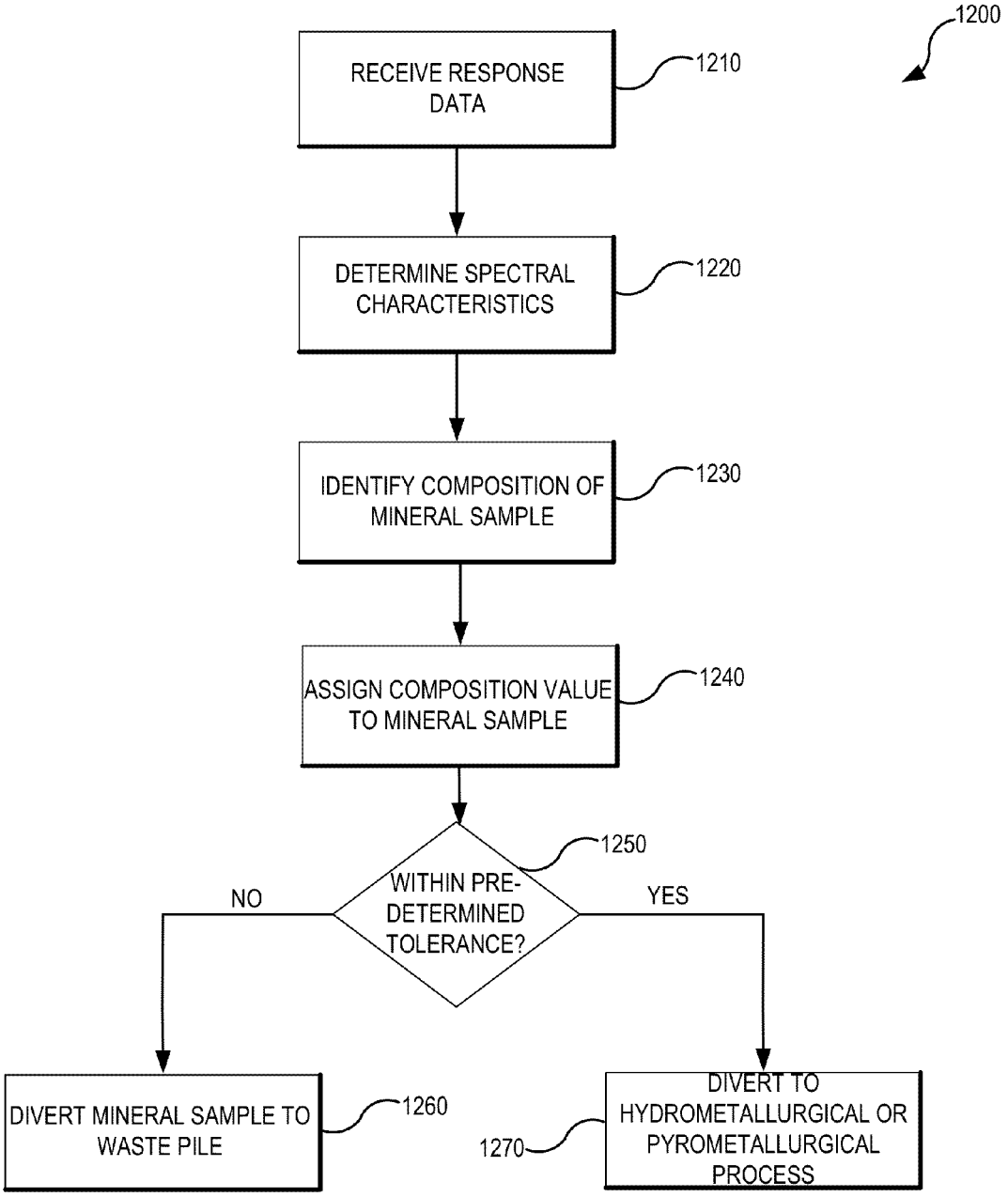
FIG. 7 is a flow chart having an example set of instructions for identifying mineral composition.

FIG. 7 is a flowchart having an example set of instructions for determining mineral content. The operations can be performed by various components such as processors, controllers, and/or other components. In receiving operation 1210, response data from a mineral sample is received. The response data may be detected by a scanner that detects the response of the mineral sample to electromagnetic radiation (i.e., reflected or absorbed energy). An analog to digital converter may digitize the response data.

In determining operation 1220, the spectral characteristics of the mineral sample may be determined. A spectral analysis may be performed on the response data to determine characteristics of the mineral sample. Characteristics may include frequency, wavelength, and/or amplitude. In some embodiments, characteristics include other user-defined characteristics.

In identifying operation 1230, a composition of the mineral sample is identified by comparing the characteristics of the mineral sample to characteristics of known mineral samples. Pattern matching algorithms may be used in identifying the composition.

In assigning operation 1240, a composition value is assigned to the mineral sample.

In decision operation 1250, it is determined whether the composition value is within a predetermined tolerance of composition values. In reject operation 1260, the assigned value of the composition is not within the predetermined tolerance (i.e., the characteristics do not fit with in a pattern), and, thus, the mineral sample is diverted to a waste pile. In accept operation 1270, the assigned value of the composition is within the predetermined tolerance (i.e., the characteristics fit within a pattern), and thus, the mineral sample is diverted to a hydrometallurgical or pyrometallurgical process.

Computer System Overview

Figure 8:
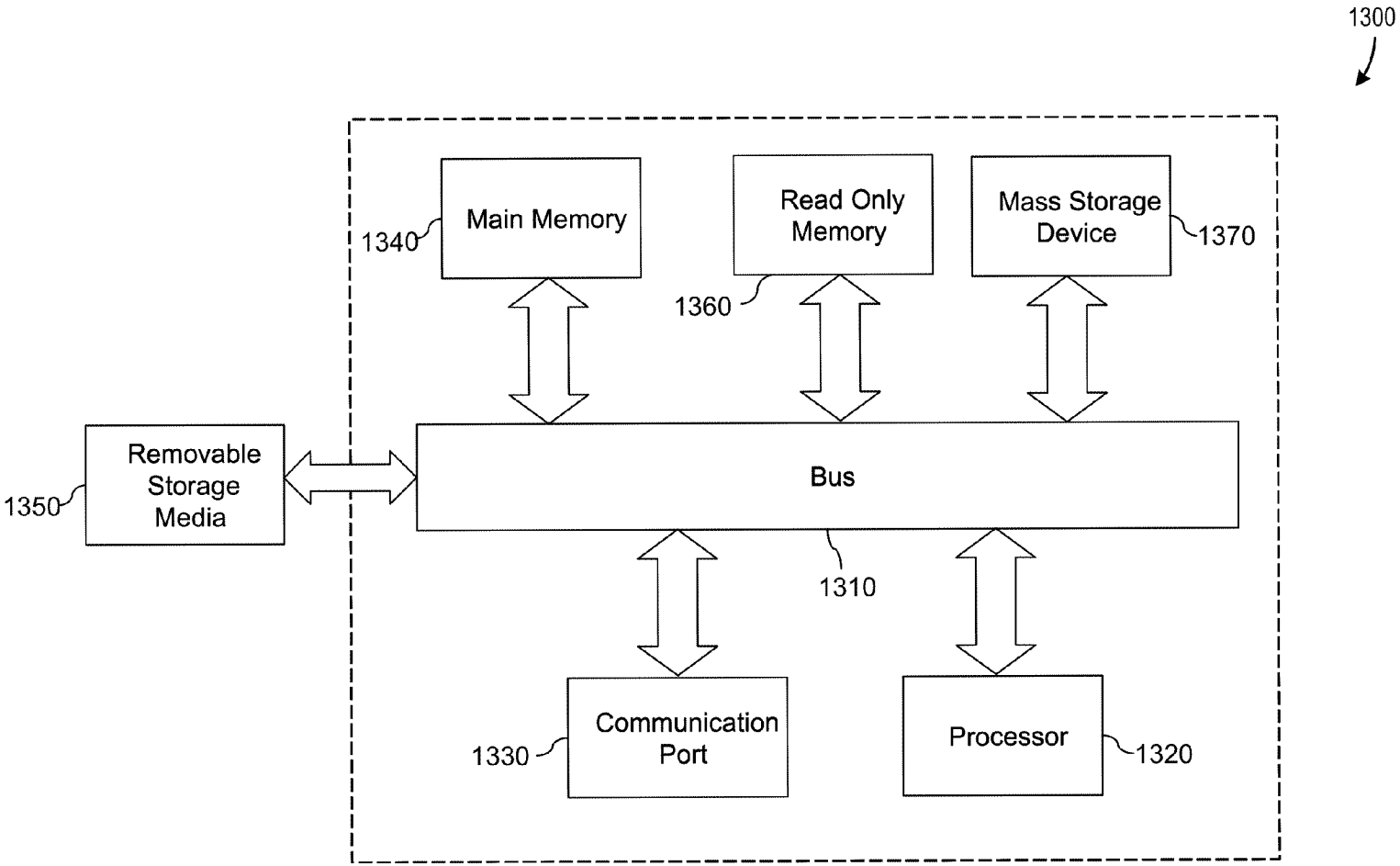
FIG. 8 an example of a computer system with which one or more embodiments of the present disclosure may be utilized.

Embodiments of the present invention include various steps and operations, which have been described above. A variety of these steps and operations may be performed by hardware components or may be embodied in machine-executable instructions, which may be used to cause a general-purpose or special-purpose processor programmed with the instructions to perform the steps. Alternatively, the steps may be performed by a combination of hardware, software, and/or firmware. As such, FIG. 8 is an example of a computer system 1300 with which embodiments of the present invention may be utilized. According to the present example, the computer system includes a bus 1310, at least one processor 1320, at least one communication port 1330, a main memory 1340, a removable storage media 1350, a read only memory 1360, and a mass storage 1370.

Processor(s) 1320 can be any known processor, such as, but not limited to, an Intel® Itanium® or Itanium 2® processor(s); AMD® Opteron® or Athlon MP® processor(s); or Motorola® lines of processors. Communication port(s) 1330 can be any of an RS-232 port for use with a modem-based dialup connection, a 10/100 Ethernet port, or a Gigabit port using copper or fiber. Communications may also take place over wireless interfaces. Communication port(s) 1330 may be chosen depending on a network such as a Local Area Network (LAN), Wide Area Network (WAN), or any network to which the computer system 1300 connects.

Main memory 1340 can be Random Access Memory (RAM) or any other dynamic storage device(s) commonly known in the art. Read only memory 1360 can be any static storage device(s) such as Programmable Read Only Memory (PROM) chips for storing static information such as instructions for processor 1320.

Mass storage 1370 can be used to store information and instructions. For example, hard disks such as the Adaptec® family of SCSI drives, an optical disc, an array of disks such as RAID, such as the Adaptec family of RAID drives, or any other mass storage devices may be used.

Bus 1310 communicatively couples processor(s) 1320 with the other memory, storage and communication blocks. Bus 1310 can be a PCI/PCI-X or SCSI based system bus depending on the storage devices used.

Removable storage media 1350 can be any kind of external hard-drives, floppy drives, IOMEGA® Zip Drives, Compact Disc-Read Only Memory (CD-ROM), Compact Disc-Re-Writable (CD-RW), and/or Digital Video Disk-Read Only Memory (DVD-ROM).

Although not required, aspects of the invention may be practiced in the general context of computer-executable instructions, such as routines executed by a general-purpose data processing device, e.g., a server computer, wireless device or personal computer. Those skilled in the relevant art will appreciate that aspects of the invention can be practiced with other communications, data processing, or computer system configurations, including: Internet appliances, hand-held devices (including personal digital assistants (PDAs)), wearable computers, all manner of cellular or mobile phones (including Voice over IP (VoIP) phones), dumb terminals, multi-processor systems, microprocessor-based or programmable consumer electronics, set-top boxes, network PCs, mini-computers, mainframe computers, and the like.

Aspects of the invention can be embodied in a special purpose computer or data processor that is specifically programmed, configured, or constructed to perform one or more of the computer-executable instructions explained in detail herein. While aspects of the invention, such as certain functions, are described as being performed exclusively on a single device, the invention can also be practiced in distributed environments where functions or modules are shared among disparate processing devices, which are linked through a communications network, such as a Local Area Network (LAN), Wide Area Network (WAN), or the Internet. In a distributed computing environment, program modules may be located in both local and remote memory storage devices.

Aspects of the invention may be stored or distributed on tangible computer-readable media, including magnetically or optically readable computer discs, hard-wired or preprogrammed chips (e.g., EEPROM semiconductor chips), nanotechnology memory, biological memory, or other data storage media. Alternatively, computer implemented instructions, data structures, screen displays, and other data under aspects of the invention may be distributed over the Internet or over other networks (including wireless networks), on a propagated signal on a propagation medium (e.g., an electromagnetic wave(s), a sound wave, etc.) over a period of time, or they may be provided on any analog or digital network (packet switched, circuit switched, or other scheme).

CONCLUSION

As one of ordinary skill in the art will appreciate based on the detailed description provided herein, and various novel concepts are realized, some of which are listed below:

1. A source-detector type electromagnetic sorting cell comprising:
   a. a device for the introduction of mineral feed to the sensor;
   b. a device for the generation of a range of excitation beams;
   c. a scanner for the detection of resulting reflected, absorbed, or backscattered energy;
   d. an analog to digital converter to digitize the signals in (c);
   e. a software program for signal analysis, data recording, and process control;
   f. a control system for processing signal outputs; and
   g. a diverter connected to the control system for the diversion of measured material.
2. A method of determining the spectral response of a mineral sample under irradiation by electromagnetic means using the system comprising the steps of:
   a. providing the source detector sensing and sorting system;
   b. exposing the sensor to a mineral sample;
   c. converting the spectral response of the mineral sample to digital format;
   d. measuring the spectral response of the mineral sample to the sensor; and
   e. converting the measured response (c) into a power spectrum.
3. A method of determining the mineral composition of an unknown sample using the sensor comprising the steps of:
   a. providing the system;
   b. measuring the spectral response due to the unknown sample as described in Claim 2;
   c. comparing the measured data in (b) to previously recorded response data from samples of known grade; and
   d. assigning a compositional value to the unknown sample based on the comparison in (c).
4. A method of discriminating mineral samples based on spectral response using the sensor comprising the steps of:
   a. providing the system;
   b. determining the characteristic spectral response of the mineral sample as described in Claims 3 and 4;
   c. using the software program in Claim 1(e) to compare the values determined in (b) to predefined spectra of previously characterized mineral samples by means of the conditional random field algorithm described; and d. Using the control system described in Claim 1(f) to control the diverter system based upon results of the comparison described in (c).

5. A method of automatically rejecting or accepting mineral samples based on spectral response using the system comprising the steps of:
   a. providing the system;
   b. discriminating between sample materials as described in Claim 12;
   c. using the software program in Claim 1(h) to generate a sort decision based on the discrimination in (b); and
   d. effecting the sort based on the decision in (c) by means of the sorting mechanism described in Claim 5.
6. A method of determining the optimal number of sorting stages for an effective and beneficial separation of the mineral stream comprising:
   a. providing the system;
   b. discriminating between sample materials;
   c. calculating the probability of correctly sensing "good" and "bad" fractions in the mineral stream;
   d. calculating the probability of correctly diverting correctly sensed "good" and "bad" fractions in the mineral stream;
   e. calculating the utility of the sorting cascade based on a priori knowledge of the above probabilities and a priori characterization of "good" and "bad" rocks to be sensed and diverted;
   f. building a sorting cascade of dimension n to achieve the calculated utility;
   g. providing m sorting cascades of dimension n to achieve the desired separation capacity at the calculated utility and capacity of a single cascade.
7. A high efficiency, high capacity mineral sorting system of m cascades in parallel with dimension n, each cascade comprising multiple cells of the type described in Claim 1, with sorting parameters for each cell as determined by the method described in Claims 2-5, and the number and arrangement of stages as determined by the method of Claim 6, comprising:
   a. a preliminary size classification stage to remove very fine material prior to sorting in the cascade(s);
   b. an optional sorting cascade of m stages and n channels sorting the very fine mineral stream ultimately delivering a single 'accept' product and a single 'reject' product to final product and tailings streams respectively;
   c. an optional second size classification stage for the separation of coarse and fine streams;
   d. a sorting cascade of dimension n and m channels sorting the coarse mineral stream ultimately delivering a single 'accept' product and a single 'reject' product to final product and tailings streams respectively;
   e. an optional sorting cascade of dimension n and m channels sorting the fine mineral stream ultimately delivering a single 'accept' product and a single 'reject' product to final product and tailings streams respectively; and
   f. final product and tailings streams combining the coarse and fine 'accept' and 'reject' products respectively.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof means any connection or coupling, either direct or indirect, between two or more elements; the coupling or connection between the elements can be physical, logical, or a combination thereof. Additionally, the words "herein," "above," "below," and words of similar import, when used in this application, refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above Detailed Description of examples of the invention is not intended to be exhaustive or to limit the invention to the precise form disclosed above. While specific examples for the invention are described above for illustrative purposes, various equivalent modifications are possible within the scope of the invention, as those skilled in the relevant art will recognize. For example, while processes or blocks are presented in a given order, alternative implementations may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed or implemented in parallel, or may be performed at different times. Further any specific numbers noted herein are only examples: alternative implementations may employ differing values or ranges.

The teachings of the invention provided herein can be applied to other systems, not necessarily the system described above. The elements and acts of the various examples described above can be combined to provide further implementations of the invention. Some alternative implementations of the invention may include not only additional elements to those implementations noted above, but also may include fewer elements. Any patents and applications and other references noted above, including any that may be listed in accompanying filing papers, are incorporated herein by reference. Aspects of the invention can be modified, if necessary, to employ the systems, functions, and concepts of the various references described above to provide yet further implementations of the invention.

These and other changes can be made to the invention in light of the above Detailed Description. While the above description describes certain examples of the invention, and describes the best mode contemplated, no matter how detailed the above appears in text, the invention can be practiced in many ways. Details of the system may vary considerably in its specific implementation, while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific examples disclosed in the specification, unless the above Detailed Description section explicitly defines such terms. Accordingly, the actual scope of the invention encompasses not only the disclosed examples, but also all equivalent ways of practicing or implementing the invention under the claims.

To reduce the number of claims, certain embodiments of the invention are presented below in certain claim forms, but the applicant contemplates the various aspects of the invention in any number of claim forms. For example, while only one aspect of the invention is recited as a means-plus-function claim under 35 U.S.C sec. 112, sixth paragraph, other aspects may likewise be embodied as a means-plus-function claim, or in other forms, such as being embodied in a computer-readable medium. (Any claims intended to be treated under 35 U.S.C. §112, ¶6 will begin with the words "means for", but use of the term "for" in any other context is not intended to invoke treatment under 35 U.S.C. §112, ¶6.) Accordingly, the applicant reserves the right to pursue additional claims after filing this application to pursue such additional claim forms, in either this application or in a continuing application.

As one of ordinary skill in the art will appreciate based on the detailed description provided herein, various novel concepts are realized. The Abstract of the Disclosure is provided to comply with 37 C.F.R. section 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate preferred embodiment.

We claim:

1. A system for sorting ore from a material-stream overflow, comprising:

a first size-classifying stage configured to separate at least a portion of the material stream overflow into at least fine fractions and coarse fractions;

a first sorting cascade comprising at least one sorting cell, wherein the first sorting cascade is configured to:

receive the coarse fractions;

detect content of at least a first desired component from the coarse fractions; and sort, based on a first grade threshold, the coarse fractions into a coarse fraction accept stream and a coarse fraction reject stream;

a second sorting cascade comprising at least one sorting cell, wherein the second sorting cascade is configured to:

receive the fine fractions;

detect content of at least a second desired component from the fine fractions; and sort, based on a second grade threshold, the fine fractions into a fine fraction accept stream and a fine fraction reject stream;

a product stream comprising the fine fraction accept stream and the coarse fraction accept stream;

a tailings stream comprising the fine fraction reject stream and the coarse fraction reject stream; and a central marshalling computer configured to determine a number of sorting cells in the first sorting cascade by:

calculating a probability of correctly determining the content of the first desired component of the coarse fractions using a sensor;

calculating a probability of correctly diverting the coarse fractions using a diverter;

calculating a utility of the first sorting cascade based on the probability of correctly determining the content of the first desired component of the coarse fractions and the probability of correctly diverting the coarse fractions; and determining the number of the at least one sorting cell in the first sorting cascade based on the calculated utility.

2. The system of claim 1, wherein detecting the content of at least the first desired component and detecting the content of at least the second desired component includes detecting the content of a same desired component in the fine fractions and the coarse fractions.

3. The system of claim 2, wherein the first grade threshold is different from the second grade threshold.

4. The system of claim 1, wherein detecting the content of at least the first desired component and detecting the content of at least the second desired component includes detecting a content of a different desired component in the fine fractions and the coarse fractions.

5. The system of claim 1, further comprising a second size-classifying stage located upstream of the first size-classifying stage and configured to separate at least a material stream into a fine material stream and the material stream overflow.

6. The system of claim 1, wherein calculating the utility of the first sorting cascade is further based on a previous characterization of the mineral sample.

7. The system of claim 1, wherein determining the number of sorting cells in the first sorting cascade further comprises:

receiving a desired separation capacity;

determining a number of sorting cascades to achieve the desired separation capacity at the calculated utility.

8. The system of claim 7, wherein each sorting cascade includes the number of sorting stages determined for the first sorting cascade.

9. The system of claim 5, wherein the product stream further comprises the fine material stream.

10. A system for sorting coarse fractions, comprising:

a sorting cascade comprising at least one sorting cell, wherein the first sorting cascade is configured to:

receive coarse fractions;

detect content of at least a first desired component from the coarse fractions; and sort, based on a first grade threshold, the coarse fractions into a coarse fraction accept stream and a coarse fraction reject stream; and a central marshalling computer configured to determine a number of sorting cells in the sorting cascade by:

calculating a probability of correctly determining the content of the first desired component of the coarse fractions using a sensor;

calculating a probability of correctly diverting the coarse fractions using a diverter;

calculating a utility of the first sorting cascade based on the probability of correctly determining the content of the first desired component of the coarse fractions and the probability of correctly diverting the coarse fractions; and determining the number of the at least one sorting cell in the first sorting cascade based on the calculated utility.

11. The system of claim 10, wherein determining the number of sorting cells in the sorting cascade further comprises:

receiving a desired separation capacity;

determining a number of sorting cascades to achieve the desired separation capacity at the calculated utility.

12. A system for sorting ore from a material-stream overflow, comprising:

a first separating mechanism configured to separate at least a portion of the material stream overflow into at least fine fractions and coarse fractions;

a first sorting mechanism comprising at least one sorting cell, wherein the first sorting mechanism is configured to:

receive the coarse fractions;

detect content of at least a first desired component from the coarse fractions; and sort, based on a first grade threshold, the coarse fractions into a coarse fraction accept stream and a coarse fraction reject stream;

a second sorting mechanism comprising at least one sorting cell, wherein the second sorting mechanism is configured to:

receive the fine fractions;

detect content of at least a second desired component from the fine fractions; and sort, based on a second grade threshold, the fine fractions into a fine fraction accept stream and a fine fraction reject stream; and a central marshalling computer configured to determine a number of sorting cells in the first sorting mechanism by:

calculating a probability of correctly determining the content of the first desired component of the coarse fractions using a sensor;

calculating a probability of correctly diverting the coarse fractions using a diverter;

calculating a utility of the first sorting mechanism based on the probability of correctly determining the content of the first desired component of the coarse fractions and the probability of correctly diverting the coarse fractions; and determining the number of the at least one sorting cell in the first sorting mechanism based on the calculated utility.

13. The system of claim 12, wherein detecting the content of at least the first desired component and detecting the content of at least the second desired component includes detecting the content of a same desired component in the fine fractions and the coarse fractions.

14. The system of claim 13, wherein the first grade threshold is different from the second grade threshold.

15. The system of claim 12, wherein detecting the content of at least the first desired component and detecting the content of at least the second desired component includes detecting a content of a different desired component in the fine fractions and the coarse fractions.

16. The system of claim 12, further comprising a second size-classifying mechanism located upstream of the first size-classifying mechanism and configured to separate at least a material stream into a fine material stream and the material stream overflow.

17. The system of claim 12, wherein calculating the utility of the first sorting mechanism is further based on a previous characterization of the mineral sample.

18. The system of claim 12, wherein determining the number of sorting cells in the first sorting mechanism further comprises:

receiving a desired separation capacity;

determining a number of sorting mechanisms to achieve the desired separation capacity at the calculated utility.

19. The system of claim 18, wherein each sorting mechanism includes the number of sorting stages determined for the first sorting mechanism.

* * * * *